US005100037A

United States Patent [19]

Kopyta et al.

[11] Patent Number: 5,100,037

[45] Date of Patent: Mar. 31, 1992

[54] TAPE RULE HOLDER

[75] Inventors: Ralph Kopyta, Rancho; Brett P. Seber, Laguna Niguel, both of Calif.

[73] Assignee: Buck Knives, Inc., El Cajon, Calif.

[21] Appl. No.: 684,986

[22] Filed: Apr. 15, 1991

[51] Int. Cl.[5] ..... B65D 25/10

[52] U.S. Cl. ..... 224/245; 224/226; 224/228; 224/235; 224/904; 24/3 R; 24/3 F

[58] Field of Search ..... 224/226, 228, 235, 242, 224/245, 246, 253, 904, 911, 236, 239, 240, 241; 24/3 R, 3 F, 3 H, 3 M; 206/305, 349; 220/85 H

[56] References Cited

U.S. PATENT DOCUMENTS

| | | | |
|---|---|---|---|
| 1,088,406 | 2/1914 | Davis | 224/904 X |
| 1,148,369 | 7/1915 | Farmer | 224/904 X |
| 1,264,190 | 4/1918 | Klenck | 24/3 R |
| 1,553,066 | 9/1925 | Burger | 224/242 |
| 1,756,677 | 4/1930 | Cook | 224/245 |
| 2,353,502 | 7/1944 | Reynolds | 24/3 F |
| 2,783,536 | 3/1957 | McQueary | 224/245 X |
| 3,191,825 | 6/1965 | Beckwith | 224/245 X |
| 3,664,560 | 5/1972 | Perkins | 224/253 X |
| 3,769,733 | 11/1973 | Nelson | 224/239 X |
| 3,841,541 | 10/1974 | Griffis | 224/253 X |
| 3,992,776 | 11/1976 | Koppe et al. | 224/253 X |
| 4,821,933 | 4/1989 | Seber | 224/904 X |

*Primary Examiner*—Henry J. Recla
*Assistant Examiner*—Glenn T. Barrett
*Attorney, Agent, or Firm*—Philip D. Junkins

[57] ABSTRACT

A tape rule holder of the type used by carpenters, plumbers, electricians and other trades persons formed from two die cut flat pieces of heavy duty, top grain saddle leather. The back piece of the tape rule holder includes belt slots in its upper section. The front piece or pocket-forming member of the tape rule holder is configured in its flat pre-assembly form with peripheral side rivet areas and a bottom rivet area, each defined by a fold line. When the front piece is riveted to the back piece there is formed a tape rule pocket comprising a front wall, side walls and a bottom wall and the side walls present on their inner portion side pocket pressure detent ridges. A leather strap member is affixed to the back piece and has a forwardly arched portion within the tape rule pocket to form an inner back pressure ridge which together with the side detent ridges apply pressure to a tape rule inserted into the leather tape rule holder to grip and maintain the tape rule therein against accidental dislodgement.

4 Claims, 1 Drawing Sheet

TAPE RULE HOLDER

BACKGROUND OF THE INVENTION

The present invention relates to tape rule holders of the type used by carpenters, plumbers, electricians and other construction and repair workers. Generally, these types of workers use during their work day heavy-duty tape rules of one inch or greater thickness carrying 25 or more feet of metallic measuring tape which is spring-wound within a metal tape rule case. Also, it is common practice for such workers and others to carry encased tape rules in a leather holder having belt slots so that the holder (along with other types of tool holders) may be mounted on a rugged waist-spanning belt.

In most instances in the past, tape rule holders have been fabricated from heavy duty, top grain saddle leather with a front leather pocket-forming piece first die cut and die molded into pocket shape and thereafter double-riveted to a leather back piece having a pair of belt slots in its upper portion. Such tape rule holders have also included a safety strap, spanning the top pocket opening, for maintaining the encased tape rule in its seated position within the holder pocket when the tape rule is not in use by the worker thereby avoiding inadvertent loss or misplacement of the tape rule.

A leather tape rule holder of the type described above, but without a top strap, has been disclosed and claimed in U.S. Pat. No. 4,821,933 granted on Apr. 18, 1989 to Brett P. Seber, one of the inventors of the tape rule holder of the present invention. The tape rule pocket of the holder of such patent includes side walls presenting inwardly projecting pressure detent ridges which together grip a tape rule inserted into the pocket and maintain the tape rule therein against accidental dislodgement. The tape rule holder of the present invention comprises an improvement of the above noted patented holder in that additional means are provided to maintain the tape rule within the pocket to guard against accidental dislodgement thereof.

It is an object of the present invention to provide a leather tape rule holder, for mounting to a worker's belt, which includes in its holder pocket configuration inner side detent ridges and an inner back pressure strap which cooperate to firmly and safely maintain a metal encased tape rule within the pocket at times when a top safety strap is not in place across the top of the tape rule.

It is a further object of the invention to provide a leather tape rule holder formed of front and back die cut flat leather pieces, and a die cut flat leather strap, with the front piece being configured so that upon riveting its side and bottom edge areas to the side and bottom edge areas of the back piece a tape rule pocket is formed which includes inner side detent ridges and with the strap being positioned within the pocket on the back piece so as to form an inner back pressure ridge, whereby the inner side detent ridges and the inner back pressure ridge cooperate to firmly grip and maintain a standard tape rule and its casing within such pocket.

Other objects and advantages of the invention will become apparent from the following summary and detailed descriptions of a preferred embodiment of the invention taken in conjunction with the ccompanying drawing figures.

SUMMARY OF THE INVENTION

The present invention relates to a tape rule holder formed from die cut front and a back pieces of heavy duty, top grain saddle leather, together with a die cut flat leather strap. The back piece includes belt slots in its upper section and a lower central slot to receive the leather strap. The front piece or pocket-forming member is configured in its flat pre-assembly form with peripheral side rivet areas and a bottom rivet area each defined by a fold line. Upon rivet assembly of the leather strap to the back side of the back piece below the lower central slot, threading of the strap through the lower central slot of the back piece, and rivet assembly of the strap (above the central slot) to the inside of the back piece, there is formed an inner back pressure ridge. Thereafter, upon rivet assembly of the front pocket-forming piece to the back piece by flat-head rivets, with the front piece bowed outwardly to form a tape rule pocket, the resulting tape rule pocket includes pressure detent ridges on each inner side wall of the pocket. Upon insertion of a standard heavy duty encased tape rule into the pocket the detent side ridges and the inner back pressure ridge cooperate to grip the encased rule and maintain same within the pocket against accidental dislodgement, even when the extended portion of the strap is not in place across the top of the tape rule.

BRIEF DESCRIPTION OF THE DRAWING FIGURES

DETAILED DESCRIPTION OF THE INVENTION

Figure 1:
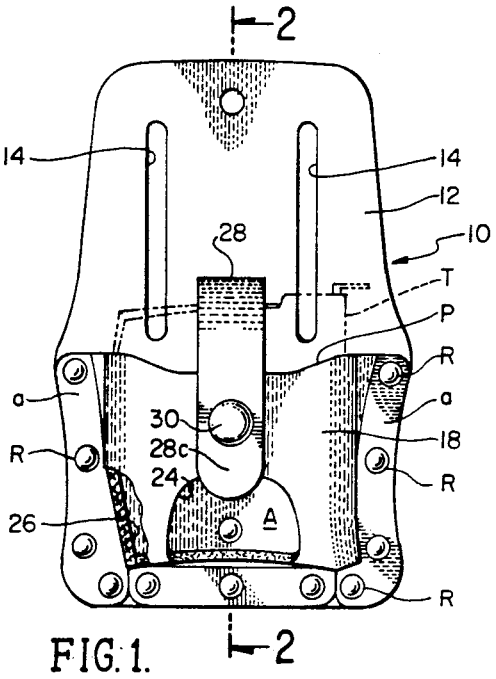
FIG. 1 is a front view of the leather tape rule holder of the present invention.
Figure 2:
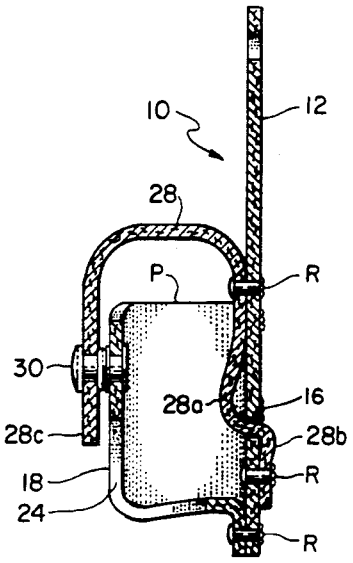
FIG. 2 is a right side sectional view of the tape rule holder of FIG. 1 taken on line 2—2 of FIG. 1.
Figure 3:
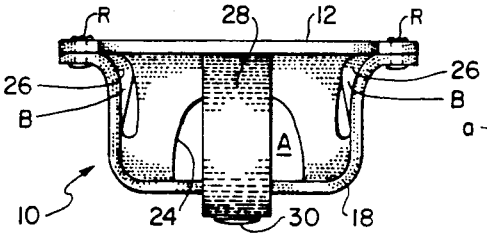
FIG. 3 is a top view of the tape rule holder of FIG. 1.

Referring now to the drawing figures, a preferred embodiment of the leather tape rule holder of the present invention is illustrated in FIGS. 1-3. The numeral 10 designates in general the assembled leather tape rule holder according to the invention with the unique built-in tape rule gripping features of the holder. The holder consists essentially of: a flat leather back piece or rear wall member 12, which includes upper belt slots 14 and a lower central slot 16 for receiving a strap member; and a front pocket-forming member 18 riveted in its peripheral side and bottom edge areas to the lower peripheral side and bottom edge areas of the back piece 12. A tape rule of common configuration is shown in phantom outline in FIG. 1 as item T.

Figure 5:
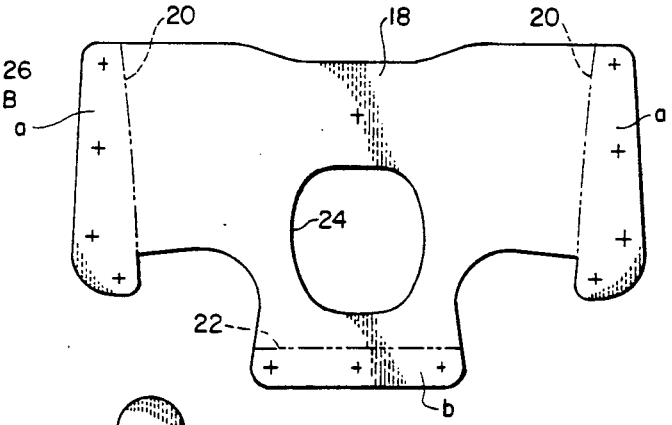
FIG. 5 is a front plan view of the front leather component used in the fabrication of the tape rule holder of FIG. 1.
Figure 4:
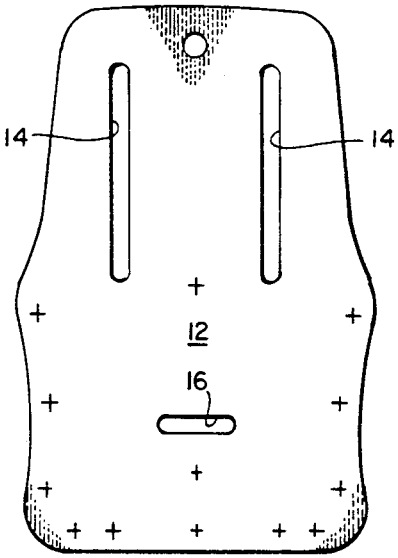
FIG. 4 is a front plan view of the leather back piece or rear component used in the fabrication of the tape rule holder of FIG. 1.

The full flat configuration of rear wall or back piece member 12, before its utilization in the assembly of the tape holder 10, is shown in FIG. 4. The pre-assembly flat configuration of pocket-forming member 18 is shown in FIG. 5. The peripheral side rivet edge areas of member 18 are designated as areas "a" defined by fold lines 20. The peripheral bottom rivet edge area of member 18 is designated as area "b" defined by bottom fold line 22. The points of placement of the leather-joining rivets are indicated for each side and bottom rivet area of pocket-forming member 18 by the small + marks in such areas. The pocket-forming member 18 of tape holder 10 (as shown in FIG. 5) is peripherally configured, and is provided with a cut-out area or port 24, so that upon its rivet affixation to back piece or rear wall member 12 (as shown in FIGS. 1–3) open ports A and B are created.

It is to be particularly noted, by reference to the cutaway portion of the tape rule holder 10 as shown in FIG. 1 (and the holder as shown in FIG. 3), that the side periphery rivet areas "a" of the pocket-forming member 18 when riveted to the back piece 12 by flat head rivets R, result in the formation of a tape rule holder pocket P which includes pressure detent ridges 26 on each inner side wall of the pocket proximate the lower and rear portion thereof.

Figure 6:
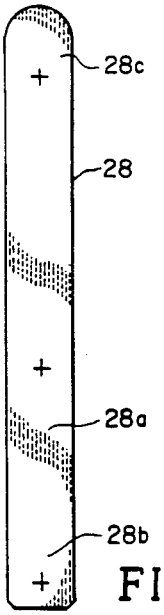
FIG. 6 is a front plan view of the leather strap used in the fabrication of the tape rule holder of FIG. 1.

The assembled leather tape rule holder 10 is provided with a leather strap 28 (shown in its flat die cut pre-assembly form in FIG. 6 with rivet placement points indicated above intermediate area 28*a* and within lower area 28*b* by the small + marks). The strap 28 is first affixed in its lower end area 28*b* to the leather back piece 12 at its lower back side by a flat head rivet as shown in FIG. 2. Thereafter the strap 28 is threaded through slot 16 and thence riveted to the inside of the back piece 12 at a point mid-way of the top and bottom edges of thereof, the intermediate strap area 28*a* being arched forwardly of the back piece to form an inner back pressure ridge within the pocket P. Preferably, the riveting of the leather strap 28 to the leather back piece 12 of the tape rule holder occurs before the leather front pocket-forming member 18 is riveted to the back piece. The free end of the strap 28, in its area 28*c*, is provided with the female portion of a two part snap fastener 30 of known design as shown in FIG. 2. The male portion of fastener 30 is affixed in known manner to the central front portion of the pocket-forming member 18.

Through the unique shape of the leather members forming the leather tape rule holder of the invention and the manner of assembly of the leather pocket-forming member 18 and the leather strap 28 to leather back piece 12, the tape rule pocket P formed thereby includes a pressure detent ridge 26 on each inner side wall of the pocket and a back pressure ridge 28*a* within the pocket. The pair of detent ridges and the back pressure ridge cooperate to hold tape rule T within the pocket P even when the extended portion of the strap is not affixed (by its snap fastener) in place across the top of the tape rule.

In the specification and drawing figures there has been set forth a preferred embodiment of a leather tape rule holder which, in accordance with the invention, includes in its pocket configuration side detent ridges and a back pressure ridge which cooperate to firmly and safely maintain a tape rule within such pocket. Although specific terms have been employed in describing the invention, they are used in a generic and descriptive sense only and are not for purposes of limitation, the scope of the invention being defined in the following claims.

What is claimed is:

1. A leather tape rule holder comprising: a back leather piece having peripheral side edge areas, a lower peripheral bottom edge area and including means adapted for mounting on a belt of the user; and a front leather piece forming a tape rule pocket comprising a front wall, side walls and a bottom wall, each of said sidewalls and said bottom wall having peripheral areas, wherein the peripheral areas of said side walls and said bottom wall project laterally and overlap said back piece, said peripheral areas being riveted to the lower peripheral side edge areas and bottom edge area, respectively, of said back piece to form side pressure detent ridges on an inner portion of the side walls of said pocket, the improvement comprising the provision of a leather strap member affixed to the back piece of said tape rule holder, said strap member having a forwardly arched portion within said pocket to form an inner back pressure ridge which together with said side detent ridges apply pressure to a tape rule inserted into said pocket to grip and maintain said tape rule therein against accidental dislodgement.

2. In a leather tape rule holder as claimed in claim 1 wherein the leather strap member affixed to the back piece of said tape holder has a free end portion which extends across the top of the tape rule inserted in said holder and may be detachably attached to the front pocket wall of said holder.

3. In a leather tape rule holder as claimed in claim 1 wherein the leather strap member affixed to the back piece of said tape holder is riveted at a lower end to a back side of said back piece, said strap member passes through a slot formed in the back piece of said tape rule holder, a portion of said strap member is formed into said forwardly arched portion within the pocket of said holder, and said strap member being riveted to the front side of said back piece above the arched portion forming the inner back pressure ridge within the pocket of said tape rule holder.

4. A leather tape rule holder comprising an elongated back leather piece having belt slots in an upper portion; and a front leather piece having a central portion for forming a front wall, side portions on each side of said central portion for forming side walls and a lower portion below said central portion for forming a bottom wall of a tape rule pocket of said holder, said side walls and said bottom wall having outer peripheral edge areas said outer peripheral edge areas overlapping and riveted, respectively, to lower peripheral side edge and bottom edge areas of said back piece to form side pressure detent on an inner portion of said side walls of said pocket, the improvement comprising the provision of a leather strap member affixed to the back piece of said tape rule holder, said strap member having a forwardly arched portion within said pocket to form an inner back pressure ridge which together with said side detent ridges apply pressure to a tape rule inserted into said pocket to grip and maintain said tape rule therin against accidental dislodgement.

* * * * *